United States Patent [19]

Kawaguchi et al.

[11] Patent Number: 4,676,726

[45] **Date of Patent: * Jun. 30, 1987**

[54] ROTARY COMPRESSOR

[75] Inventors: Susumu Kawaguchi; Takuho Hirahara; Kazuhiro Nakane, all of Shizuoka; Sei Ueda, Shimizu, all of Japan

[73] Assignee: Mitsubishi Denki Kabushiki Kaisha, Tokyo, Japan

[ * ] Notice: The portion of the term of this patent subsequent to Jan. 13, 2004 has been disclaimed.

[21] Appl. No.: 800,023

[22] Filed: Nov. 20, 1985

Related U.S. Application Data

[63] Continuation-in-part of Ser. No. 760,627, Jul. 30, 1985.

[30] Foreign Application Priority Data

Aug. 22, 1984 [JP] Japan ..... 59-174562

[51] Int. Cl.[4] ..... F04C 18/00

[52] U.S. Cl. ..... 418/54; 418/63

[58] Field of Search ..... 418/63–67, 418/54, 270

[56] References Cited

U.S. PATENT DOCUMENTS

| | | | |
|---|---|---|---|
| 2,988,267 | 6/1961 | Kosfeld | 418/63 |
| 3,056,542 | 10/1962 | Galin | 418/63 |
| 3,105,633 | 10/1963 | Dellario | 418/63 |
| 4,427,351 | 1/1984 | Sano | 418/63 |
| 4,537,567 | 8/1985 | Kawaguchi | 418/63 |

FOREIGN PATENT DOCUMENTS

| | | |
|---|---|---|
| 98064 | 10/1924 | Austria . |
| 39-24260 | 10/1964 | Japan . |

*Primary Examiner*—Carlton R. Croyle
*Assistant Examiner*—Jane E. Obee
*Attorney, Agent, or Firm*—Oblon, Fisher, Spivak, McClelland & Maier

[57] ABSTRACT

An eccentric part of a crank shaft rotated in a cylinder is made a large diameter and a thin-walled rolling piston is fitted to the outer circumference of the eccentric part so that an injection opening for supplying a refrigerant into the cylinder is covered in a certain section by only a side surface of the eccentric part or both the side surfaces of the rolling piston and the eccentric part.

2 Claims, 6 Drawing Figures

FIGURE 1
PRIOR ART
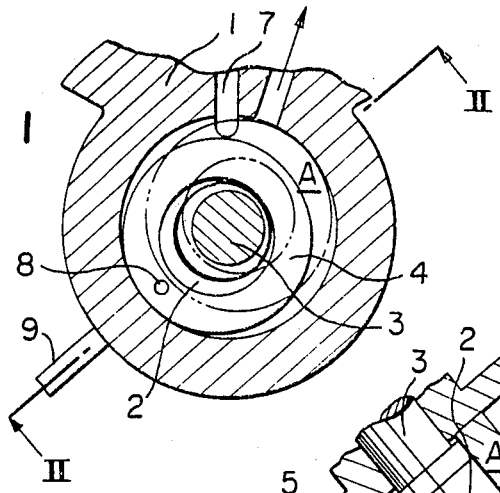
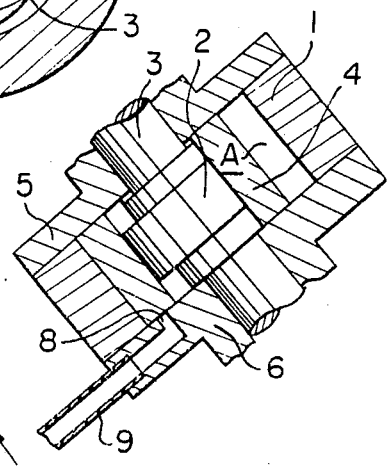
FIGURE 2
PRIOR ART
FIGURE 3
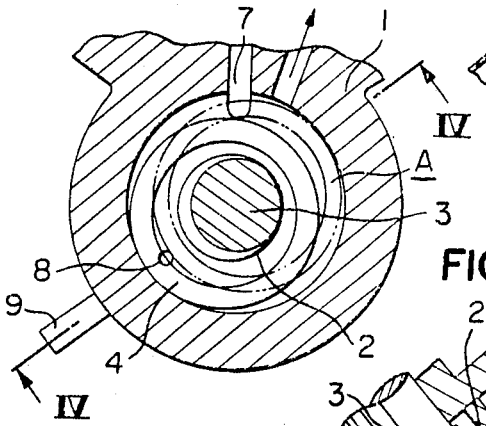
FIGURE 4
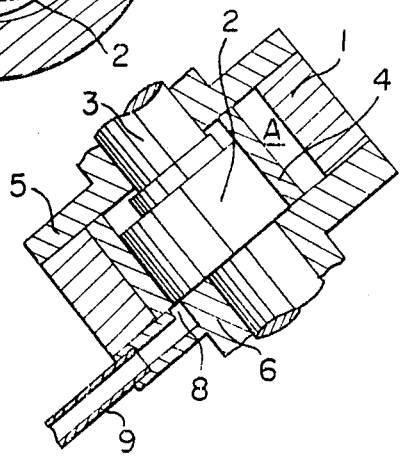

ROTARY COMPRESSOR

This is a continuation-in-part of U.S. application Ser. No. 760,627, filed July 30, 1985.

BACKGROUND OF THE SPECIFICATION

The present invention relates to a rotary compressor. More particularly, it relates to a rotary compressor of a type when an injection opening is formed in a bearing plate for a crank shaft for driving a rolling piston to supply a refrigerant into a compression chamber.

FIGS. 1 and 2 are cross-sectional views showing an important part of a conventional rotary compressor as shown in Japanese Unexamined Patent Publication No. 24260/1964. As shown in FIGS. 1 and 2, the conventional rotary compressor is so constructed that a crank shaft 3 having an eccentric part 2 is driven in a cylinder 1 by a motor so that a rolling piston 4 fitted to the eccentric part 2 is subjected to eccentric rotation in the cylinder 1 to thereby compress a refrigerant gas sucked in the cylinder 1. The crank shaft 3 is passed through and rotatably supported by both outer bearing plates 5, 6. A compression chamber A is formed between the both outer bearing plates 5, 6, inside the cylinder 1 and a vane 7 which is slidably held by the cylinder 1 and has an end portion being in contact with the outer circumferential surface of the rolling piston 4. An injection opening 8 for supplying the refrigerant into the compression chamber A is formed in either bearing plate, e.g. the bearing plate 6. The injection opening 8 is communicated with an exterior refrigerant circulating circuit through a piping 9.

In the conventional rotary compressor, the injection opening 8 is closed by only a side surface of the rolling piston 4 fitted to the crank shaft 3. Accordingly, it is unavoidable that the wall thickness of the rolling piston 4 should be large in consideration of the inner diameter of the injection opening 8. This results in reduction in the inner diameter of the rolling piston 4 from the viewpoint of limitation of the inner diameter of the cylinder 1 thereby causing a small diameter of the eccentric part 2. When the diameter of the eccentric part 2 is small, reliability of the crank shaft is decreased and application to a compressor having a large capacity has been hindered.

SUMMARY OF THE INVENTION

It is an object of the present invention to provide a rotary compressor which allows the diameter of an eccentric part of a crank shaft to be large in comparison with the inner diameter of a cylinder to thereby increase reliability.

The foregoing and the other objects of the present invention have been attained by a rotary compressor comprising a crank shaft for driving a rolling piston and bearing plates to support the crank shaft, in which an injection opening is formed in at least one bearing plate to supply a refrigerant into a compression chamber formed inside the bearing plate, wherein the injection opening is formed at a in the bearing plate such that the injection opening, is closed solely by a side surface of an eccentric part of said crank shaft or by side surfaces of both the rolling piston and the eccentric part during a revolution of the crank shaft.

BRIEF DESCRIPTION OF THE DRAWINGS

FIG. 1 is a cross-sectional view of an important part of a conventional rotary compressor;

FIG. 2 is a longitudinal cross-sectional view taken along a line II—II in FIG. 1;

FIG. 3 is a cross-sectional view of an important part of an embodiment of the rotary compressor according to the present invention;

FIG. 4 is a longitudinal cross-sectional view taken along a line IV—IV in FIG. 3;

DETAILED DESCRIPTION OF THE PREFERRED EMBODIMENTS

Figure 5:
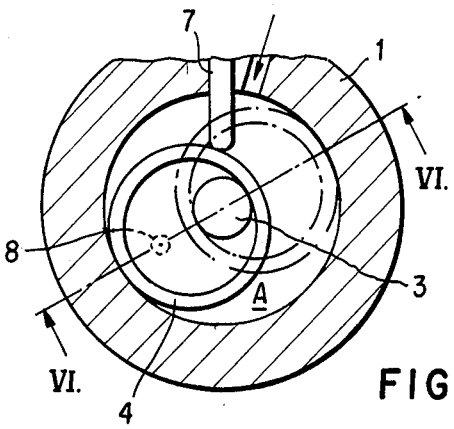
FIG. 5 is a cross-sectional view of an important part of another embodiment of the rotary compressor of the present invention.

An embodiment of the present invention will be described with reference to the drawing, In FIGS. 3 and 4, a rotary compressor of an embodiment of the present invention is provided with a cylinder 1 in which a crank shaft 3 having an eccentric part 2 is rotatably supported. The crank shaft 3 is driven by a motor and a rolling piston 4 of a ring form having a thin wall which is rotatably fitted to the outer circumferential surface of the eccentric part 2 is subjected to eccentric rotation in the cylinder 1 to thereby compress a refrigerant gas sucked in the cylinder 1. One side surface of the eccentric part 2 is in slide-contact with an inner surface of a bearing plate 6 in which an injection opening 8 is formed to supply the refrigerant gas into a compression chamber A. The compression chamber A is formed by the inner circumference of the cylinder 1, bearing plates 5, 6 attached to both sides of the cylinder 1 to support the crank shaft 3 and a vane 7 extending from the inner circumference of the cylinder 1 between the bearing plates 5, 6, the top end of the vane 7 being in slide-contact with the outer circumference of the rolling piston 4. Thus, during one revolution of the crank shaft 3 in the cylinder 1, there is a portion of the rotation when the injection opening 8 is closed by the side surfaces both the rolling piston 4 and the eccentric part 2. This is due to the eccentric part 2 having a circumference which reaches radially to at least the position of the injection opening. The injection opening 8 is communicated with a refrigerant circulating circuit provided outside of the compressor through a piping 9.

Figure 6:
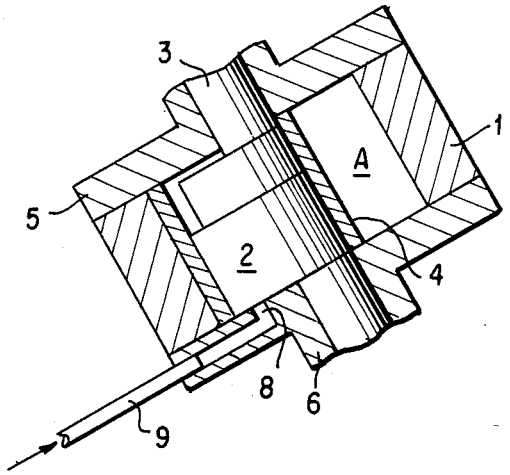
FIG. 6 is a longitudinal cross-sectional view taken along a line I—I in FIG. 5.

FIGS. 5 and 6 show another embodiment of the present invention in which the same reference numerals designate the same parts.

In this embodiment, eccentricity of the eccentric part 2 of the crank shaft 3 is further increased and the thickness of the rolling piston is reduced sufficiently so that an injection opening 8 is in a position that during a portion of a rotation the injection opening 8 is closed solely by a side surface of the eccentric part 2.

With the construction as above-mentioned, the wall thickness of the rolling piston can be reduced with the result of increasing the diameter of the eccentric part of the crank shaft 3, whereby the wall thickness of the rolling piston 4 can be reduced in comparison with a conventional rotary compressor. Accordingly, the construction as above-mentioned is applicable to a compressor having a large capacity and increased reliability of the bearings. Further, it is possible to increase the effect of injection of the refrigerant by making the diameter of the injection opening larger than the conventional opening.

In accordance with the rotary compressor of the present invention, coverage of the injection opening for supplying the refrigerant into the compression chamber is performed, during certain portions of the rotation by only the a side surface of the eccentric part or by side surfaces of both the rolling piston and the eccentric part. Accordingly, there is no restriction in the reduction of the wall thickness of the rolling piston as is conventional, and the diameter of the eccentric part of the crank shaft can be made larger depending on the reduced wall thickness of the rolling piston. The increased diameter of the eccentric part increases efficiency of compression and improves the effect of injection by permitting a larger injection opening in comparison with one of the conventional type. The present invention is applicable to a compressing device having a large eccentricity (a large capacity) in the eccentric part of a crank shaft.

We claim:

1. A rotary compressor comprising:

a crank shaft for driving a rolling piston;

bearing plates to support said crank shaft; and an injection opening formed in at least one bearing plate to supply a refrigerant into a compression chamber formed inside said bearing plate, wherein said injection opening is formed at a position in said bearing plate such that said injection opening is closed by side surfaces of both said rolling piston and said eccentric part during one revolution of said crank shaft.

2. A rotary compressor according to claim 1, wherein:

(a) said crank shaft has an eccentric part in said compression chamber; said eccentric part has an outer circumference which reaches a position of said injection opening during the revolution of said crank shaft and said eccentric part has a side surface in slide-contact with said bearing plate in which said injection opening is formed;

(b) said rolling piston is rotatably fitted to said outer circumference of said eccentric part and a side surface of said rolling piston is in slide-contact with said bearing plate.

* * * * *